US006341427B1

(12) United States Patent
Tepley

(10) Patent No.: US 6,341,427 B1
(45) Date of Patent: Jan. 29, 2002

(54) WINDOW CASING INSTALLATION TOOL

(76) Inventor: Brian J. Tepley, Rte. 1, Box 16A, Eagle Bend, Todd, MN (US) 56446

( * ) Notice: Subject to any disclaimer, the term of this patent is extended or adjusted under 35 U.S.C. 154(b) by 0 days.

(21) Appl. No.: 09/448,963

(22) Filed: Nov. 24, 1999

(51) Int. Cl.[7] ..... E04F 21/00

(52) U.S. Cl. ..... 33/194; 33/429; 33/482; 52/749.1; 52/DIG. 1

(58) Field of Search ..... 33/194, 429, 474, 33/476, 481, 482, 613, 562; 52/127.2, 749.1, DIG. 1

(56) References Cited

U.S. PATENT DOCUMENTS

| | | | | | |
|---|---|---|---|---|---|
| 79,175 | A | * | 6/1868 | Winterbottom | 33/429 |
| 313,197 | A | * | 3/1885 | Gaylord | 33/429 |
| 389,647 | A | * | 9/1888 | Hall et al. | 33/354 |
| 2,473,639 | A | | 6/1949 | Erickson | |
| 3,293,764 | A | | 12/1966 | Born | |
| 4,355,471 | A | * | 10/1982 | Cross | 33/474 |
| 4,989,336 | A | | 2/1991 | Waltrip, Jr. et al. | |
| 5,349,758 | A | | 9/1994 | Bear | |
| 5,604,988 | A | | 2/1997 | Costelloe | |
| 5,737,844 | A | * | 4/1998 | Brumbley | 33/194 |
| 5,775,036 | A | | 7/1998 | Stanley | |
| 6,145,206 | A | * | 11/2000 | Piccirillo | 33/194 |

* cited by examiner

*Primary Examiner*—Christopher W. Fulton
(74) *Attorney, Agent, or Firm*—Albert W. Watkins

(57) ABSTRACT

A small, hand-held tool enables rapid and repetitive placement of window and door casing. The tool is formed from three distinctive, generally rectangular layers. The center, sandwiched layer extends beyond the outer two layers by an amount equal to the desired offset or reveal of the casing. An extension protrudes diagonally from one side of the center layer and forms a one hundred and thirty-five degree angle with an adjacent side. This extension enables the tool holder to accurately place the corners of each casing strip, after the strips have been cut at the normal diagonal forty-five degree angle. A hole through the center of each of the layers provides for easy and solid grasping and manipulation. Scribe marks may also be provided, to more readily assist the tool user to mark, measure or visually discriminate various distances and geometries. Additional alternative features are further described in the disclosure.

16 Claims, 4 Drawing Sheets

WINDOW CASING INSTALLATION TOOL

BACKGROUND OF THE INVENTION

1. Field of the Invention

This invention pertains generally to tools used in building construction. More specifically, an easy-to-use hand-held tool enables rapid and precise location and installation of casing about windows or doors during installation.

2. Description of the Related Art

In the construction of buildings, it is common practice to frame portals such as window openings and doorways with lumber or other structural components. For the purposes of this disclosure, framing will be understood to maintain spacing and provide structural integrity, the framing often extending between an interior surface of a building structure and an exterior surface. Into the framing, a prefabricated door or window may be mounted and rigidly supported relatively quickly and reliably.

Because windows and doors can not be specified to an exact size, but instead will vary in dimension somewhat due to tolerances and other factors, and because further shimming may be required for leveling, the framing material is preferred to have a slightly larger opening than the window or door's outer perimeter. The resulting gap between rough framing and door or window jamb may be relatively large and quite unsightly. Various caulking and insulation may be applied into the gap to improve energy efficiency and building comfort, but this caulk and insulation only further add to the unsightly appearance in the vicinity of the rough framing and jamb. In view of the limitations regarding rough framing and materials adjacent the jamb, it would make little sense to spend the time necessary in preparation and cutting of wall board to be perfectly precise. To save time and to greatly simplify effort, wall board is only rough cut to the approximate dimension of the opening, and may also have an uneven edge. In summary then, the junctions between framing lumber, window and door jambs, and wall boards are quite unsightly.

To improve the otherwise unsightly appearance of an opening, it is common practice to finish the opening with decorative trim pieces that conceal the uneven edges, gaps, caulking and insulation. These decorative trim pieces, for the purposes of this disclosure and also commonly in the trade, are referred to as casing. Casing, usually fabricated from wood, is finished on three sides, while the fourth side will be concealed from view and so is commonly left unfinished. For the purposes of this disclosure, casing will not be limited to wood, but is instead defined herein to include plastics, metals and other materials provided for use as decorative trim about a portal. Where casing intersects or joins to form a right angle with a perpendicular casing piece, the intersection is most commonly cut diagonally, so that each casing is cut at a forty-five degree angle to the long side of the trim. The diagonal cut offers an improved appearance, while further insuring coverage and concealment of underlying seams and other unsightly details.

Because of the more desirable diagonal cut and the need for a well-fit, highly finished appearance, the preparation of casing for portals is quite difficult and undesirably time consuming. Windows are particularly difficult, since all four casing pieces must align perfectly, though doors also require two well-finished intersections and well spaced reveal about three surfaces. In the prior art, there are a limited number of methods and tools available to address this very old problem.

Among the earliest tools used for the installation of casing are rules and squares. These devices are first used to mark the desired location of each component, to next measure from the marks the dimensions that would be necessary, and then to mark raw material for cutting. Once the raw materials are marked, they are cut and placed. As it might appear, there are many opportunities for error and deviation from the exact dimensions using rules and squares. For example, measurement from marks is rarely more accurate than within a thirty-second of an inch, and may deviate by a sixteenth or more, depending upon the skill of the carpenter. Cutting is generally less precise than the measurement, due to kerfs, smoothness or roughness of the kerf, and other similar factors. Final placement will also vary, depending upon the viewing angle of the carpenter. For example, the original mark may have been drawn from a view looking to the right over the rule or square, while placement may occur looking over the casing from the left. This optical variation may be as great as the other possible variants. Finally, during the installation, the carpenter must prevent the casing from moving, which can also be very difficult.

While the deviations between measurement, cut and placement may cancel each other in some instances, in other instances these deviations will be additive. That is, if each individual deviation was one-sixteenth of an inch, the resulting total deviation may be one-quarter of an inch. For many applications in carpentry this deviation may not adversely affect the appearance or quality of the work. However, with casing such as used around windows or doors, where the junctions are at forty-five degree angles, these deviations become quite pronounced. Further complicating the issue is the need, with windows, to form four such junctions around the window. All too often, the intersections may be tight at one edge of the trim, such as the inside perimeter, but then be fully separated by the amount of the deviation at the other edge, such as the outer perimeter, resulting in a visual emphasis of the deviation. Unfortunately, the deviation may not be easily taken up at some other location, since all four corners must align at the same forty-five degree angle. This can lead to a frustrating and time-consuming removal of the casing and additional sawing to bring the individual trim pieces to a more exact fit.

Other more specialized tools have been developed to help with the installation of casings. For example, Erickson in U.S. Pat. No. 2,473,639, the contents incorporated herein by reference, illustrates a tool for marking a doorjamb to show where the door casing should be placed. Like rulers and squares, the Erickson gauge is quite helpful in marking the proper location for the casing. However, as also required with rulers and squares, the measurements must still be taken from those markings and the cuts made from the measurements, and then the casing applied as best as possible in alignment with the markings. Since the Erickson device leaves a scribe in the doorjamb, it is critical that the casing cover the marking as well, which may be fairly difficult to do consistently at a construction site.

More recently, Bear in U.S. Pat. No. 5,349,758, the contents incorporated herein by reference, illustrates a more complex square capable of performing marking in a fashion similar to the Erickson device. In the Bear patent, a pencil may be inserted into one of a number of preselected holes, and the square slid along a door or window jamb to draw a line. While the pencil is an improvement over the scribe of the Erickson device, there is still a need to mark the entire jamb, and subsequently measure and cut the material, and finally very carefully align the material to the marks and secure the material thereto. Furthermore, the Bear square is rather large and unwieldy, making it undesirable to store and transport, and more difficult to use at the construction site than would be preferred.

Born in U.S. Pat. No. 3,293,764, also incorporated herein by reference, provides a construction gauge that clamps into doorways and windows, to assist with placement and also, in one embodiment, cutting of window and doorway casing. A spring clamp holds the gauge on both sides of the opening, and edges are provided for a predetermined offset. In one embodiment, a forty-five degree angle is also provided which ensures accurate placement of casing. Nevertheless, while the Born patent offers many advantages, there still remain several limitations. First, because the Born gauge is spring mounted, several gauges are required to be placed, prior to installing any casing. This adds to the purchase price and requires the carpenter to carry more tools, which is undesirable. Additionally, several different types of gauges are required to be used, varying depending upon how many trim strips have been placed. Furthermore, because the gauge is clamped into the wall, it is not possible for the carpenter to guide the casing into alignment throughout the installation. In other words, as a carpenter begins to nail casing to jamb, a nail may undesirably draw the casing one direction or another, leading to a slight angular offset. Unless the carpenter continually looks away from the casing to the ends where the gauges are located, after each nail has been driven home, the carpenter will not know this offset has occurred. By the time the carpenter reaches an end where the gauge is located, the casing may be completely destroyed and worthless. As is known, casing once nailed is usually not worth re-use. Between the different, although similar, types of gauges required to install a single window or door, and the concurrent risk of wasted trim and carpenter's time, the Born invention is not as beneficial to those in the trade as is desired.

Waltrip, Jr. et al in U.S. Pat. No. 4,989,336; Costelloe in U.S. Pat. No. 5,604,988; and Brumley in U.S. Pat. No. 5,737,844 are also incorporated herein by reference. Each disclose various hand-held gauges which are disclosed as having utility in the installation of casings. More recently, air guns have also been developed that enable a carpenter to, with only one hand controlling the gun, drive nails into lumber quickly and efficiently. Rather than having to hold the nail and hammer, which in the past typically required both hands, the air gun allows a carpenter one hand free for holding or adjusting the work which is being nailed.

In spite of the many beneficial advancements in the art, there continues to be a need for a small and portable tool which will assist a carpenter in the otherwise difficult installation of window and door casing.

SUMMARY OF THE INVENTION

In a first manifestation, the invention is a window casing installation tool for accurately aligning casing to first and second generally planar faces of a portal jamb. A first generally planar surface is provided on the tool for abutting with the first jamb face, and a second generally planar surface is provided on the tool for abutting with the second jamb face. A third generally planar surface is provided for abutting with the casing piece, and is spaced from the first tool surface by a predetermined reveal amount. A fourth generally planar surface abuts with the casing at the diagonal cut edge, extending at a one hundred and thirty-five degree angle from the third surface. The tool may be engaged with the portal jamb and casing engaged with third and fourth surfaces, to precisely and repeatedly locate casing relative to jamb.

In a second manifestation, the invention is a method for installing trim about a portal. The steps include: placing a guide against the jamb; moving the guide along the jamb until the guide engages a corner of the portal; abutting the trim against the guide; and fastening the trim relative to the portal.

In a third manifestation, the invention is a hand-held tool for accurately locating window casing during installation. First and second rectangular frames each surround a third frame. The third frame extends beyond the first and second frames along three faces of a rectangle. A protrusion on the third frame extends from what would otherwise be the fourth rectangular side in a triangular configuration, with one edge of the protrusion extending at a one hundred and thirty-five degree angle from one edge of the otherwise rectangular third frame. There is a central opening coextensive through each of the three frames through which a hand may pass and grasp the tool. The hand-held tool may be used to measure and locate a reveal using any of the three rectangular edges of the third frame in conjunction with an associated edge of either the first or second frame. The protrusion from the third frame may be used in conjunction with the other features of the invention to locate the end of a pre-cut casing strip adjacent a portal in all three dimensions.

OBJECTS OF THE INVENTION

A first object of the invention is to provide a relatively small hand held tool which will assist a carpenter in the installation of casing and other trim, without requiring substantial space for storage or being unwieldy at the job site. A second object of the invention is to enable the carpenter to securely grasp and manipulate the tool, allowing substantial force to be applied through the tool, as required. A further object of the invention is to include within the tool a predetermined measure of offset, also sometimes referred to as reveal, and also a predetermined forty-five degree angle for accurate placement of a single piece of casing adjacent a portal. Another object of the invention is to continuously ensure accurate placement during installation, by sliding the tool along a jamb surface, thereby enabling rapid installation using modern tools such as nailing guns. These and other objects are accomplished in the preferred embodiment, which will be better understood when considered in conjunction with the appended drawing figures.

DESCRIPTION OF THE PREFERRED EMBODIMENT

Figure 1:
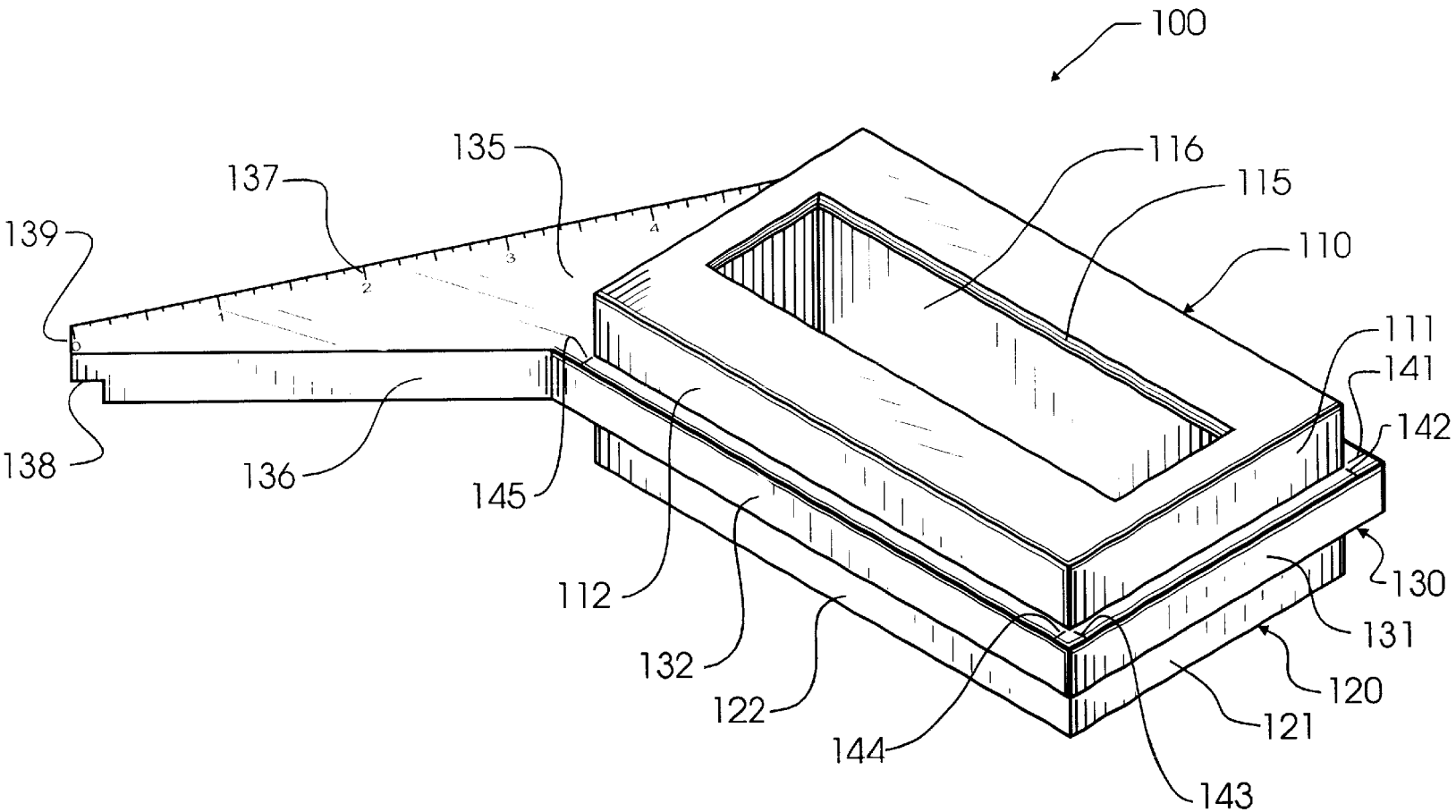
FIG. 1 illustrates a preferred embodiment casing installation tool in accord with the invention, from a projected view.
Figure 2:
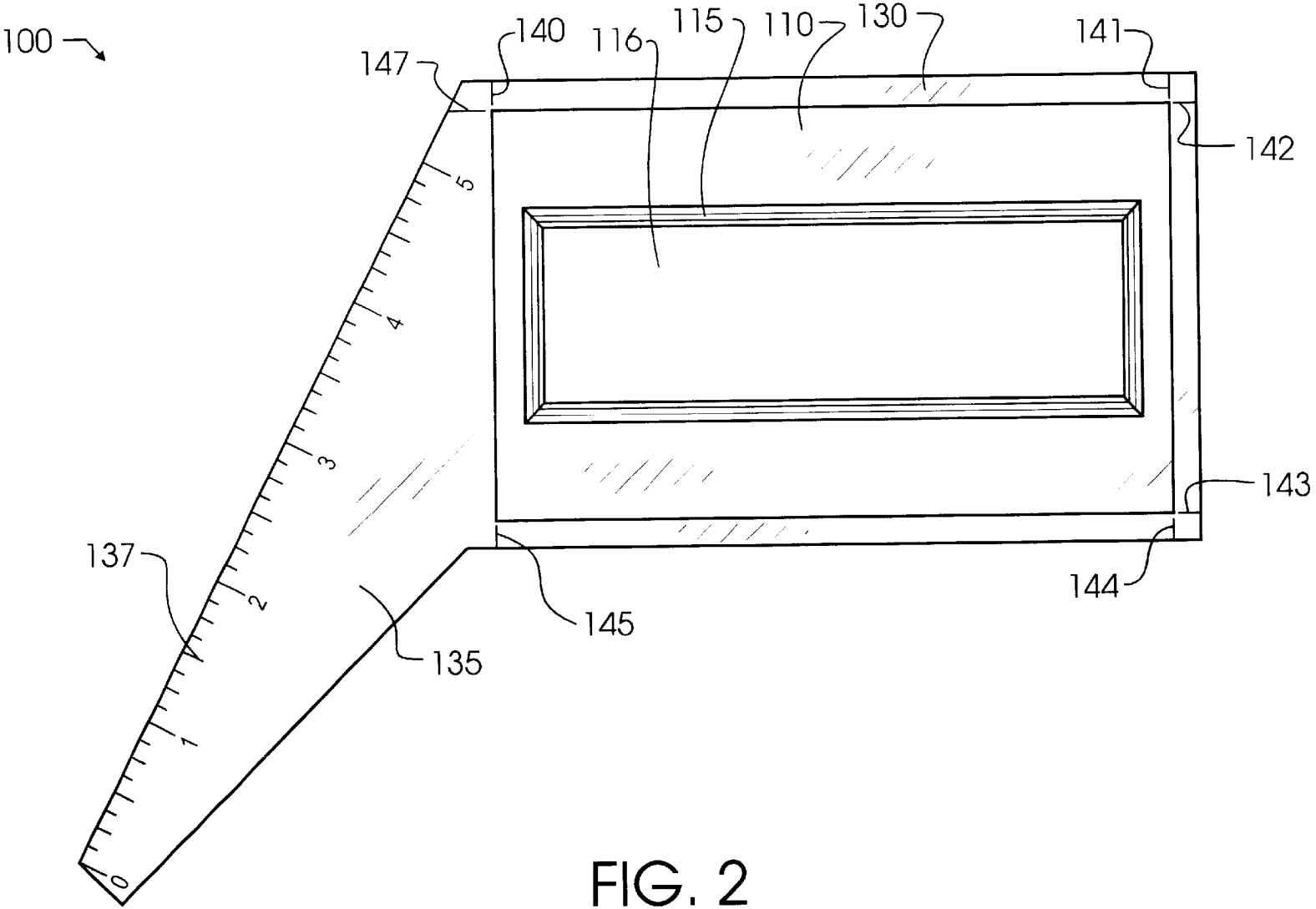
FIG. 2 illustrates the preferred embodiment from a top plan view.
Figure 3:
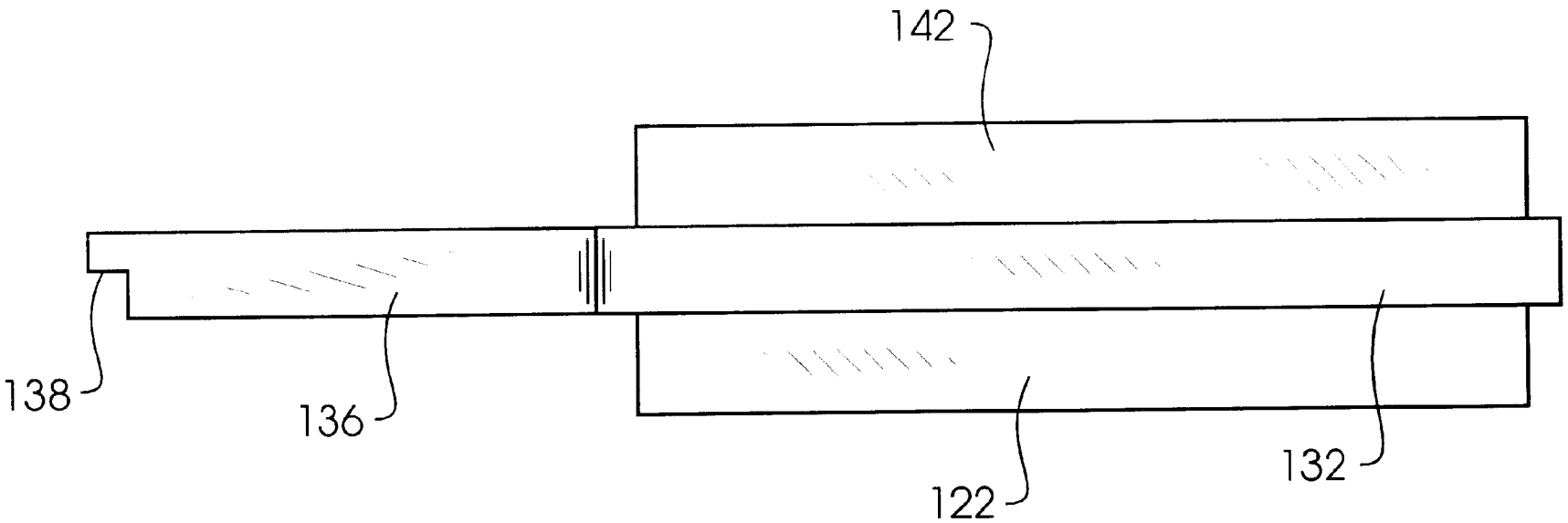
FIG. 3 illustrates the preferred embodiment from a side plan view .

Casing installation tool 100 is designed from three layers of material, which may be formed as a unitary assembly or which may each be formed separately and then assembled together. The layers may be formed from a variety of materials, including plastics, metals, wood, or other material with little restriction. However, in the most preferred embodiment, a clear plastic such as Acrylic, Lucite, or polycarbonate offers added advantage where scribe marks, discussed herein below, are used, due to the inherent transparency of the material. Top and bottom layers 110 and 120 sandwich center layer 130. Extending entirely through each of the three layers is a hole 116, which in the preferred embodiment is rectangular, and sized to comfortably accept a person's hand. At the entrance to hole 116, the edge 115 is beveled or slightly rounded, to improve comfort and ease of use.

Center layer 130 is designed to extend slightly beyond layers 110 and 120, in the preferred embodiment by three-sixteenths of an inch on each of the three regular rectangular sides of layer 130. More specifically, edge 131 extends three-sixteenths of an inch from edges 111 and 121, while edge 132 extends three-sixteenths of an inch from edges 112 and 122, and so forth. This is the preferred amount for set-back or reveal of window casing around the window jamb, though this distance may be varied depending upon the preferences of the tool designer or casing installer. In alternative embodiments, center layer 130 may extend by more or less amounts. Furthermore, different edges may be designed to different predetermined offsets. So, for example, while edge 132 extends by three-sixteenths, edge 131 in an alternative embodiment might only extend one-eighth of an inch. Each of the three sides might extend by different amounts, though, in the preferred embodiment tool designed primarily for window casing installation, three-sixteenths on each side allows the user to grasp and apply the tool from many different directions relative to the work and still get the prescribed distance.

As a visual aid to assist with proper placement, guiding and, where required, marking, small scribes 140–147 are provided in each major surface of layer 130. Scribes 140–147 are placed adjacent each planar edge of layers 110 and 120, and extend parallel therefrom. As a result, there is easy visual indication of alignment with edges on layer 10 or 120, such as edges 112 or 121. In addition, scribes 140–147 also provide a means for marking various points around an opening or portal, as desired, at the appropriate predetermined three-sixteenths of an inch offset.

A large angular extension 135 is provided that enables rapid marking, when desired, and, very importantly, also enables accurate placement of casing around a portal. Extending from edge 132 and at a one hundred and thirty-five degree angle thereto, is edge 136. Ruler graduations may be provided along edge 136, or along one or more portions of a major surface of extension 135, such as shown by ruler scale 137 in the preferred embodiment. Ruler scale 137 enables tool 100 to serve a more diverse set of needs, including standard rule and marking functions. As noted, these or similar graduations may be provided along any of the surfaces of tool 100, and in some cases will be desirable, though the marking of extension 135 provides extra synergism in these otherwise difficult to calculate angularly offset directions.

Figure 4:
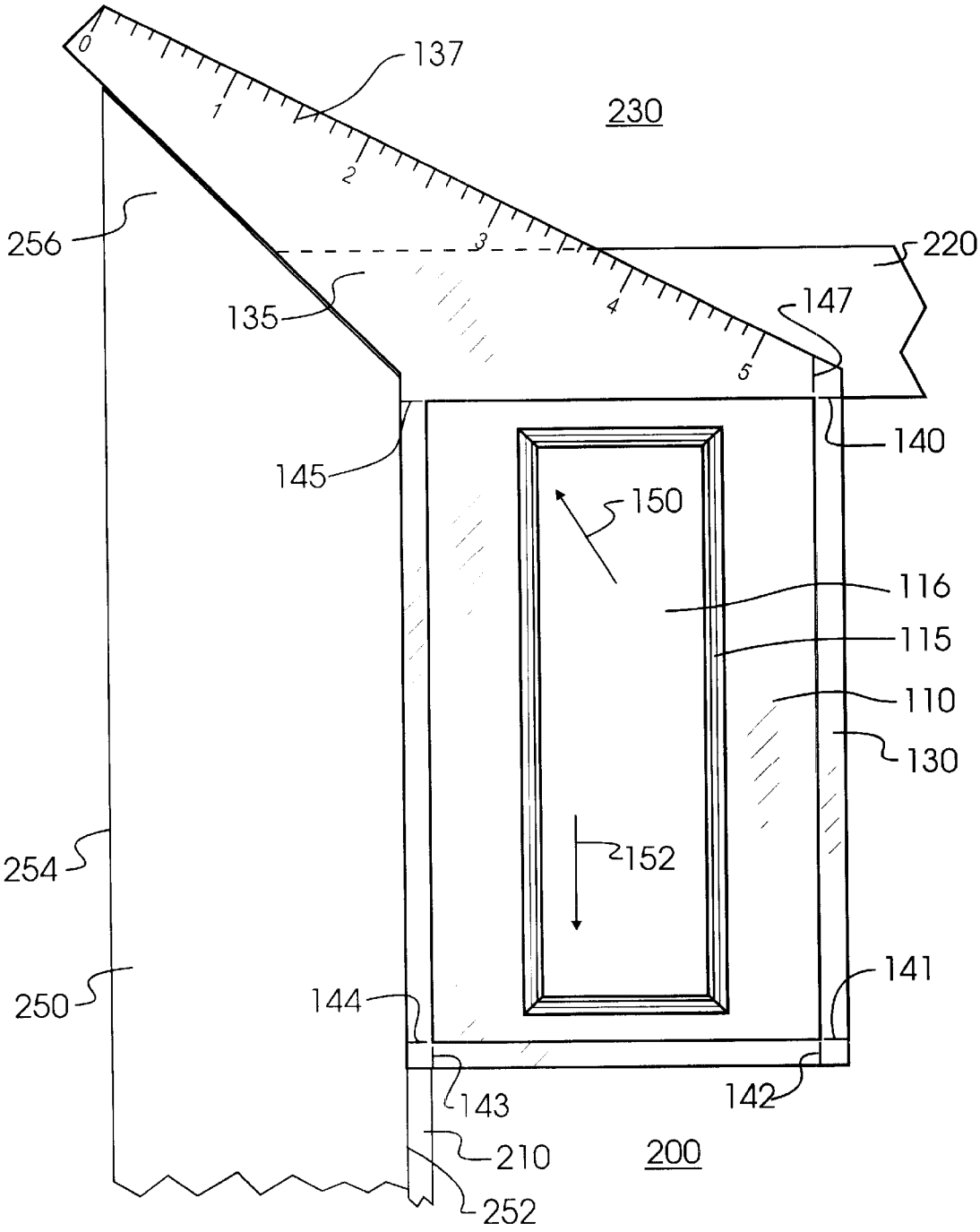
FIG. 4 illustrates the use of the preferred embodiment in installing casing.

A small notch 138 may most preferably be provided at the end of extension 135, which is preferably cut three-sixteenths of an inch. This small notch allows an installer to measure and position small or irregular components, or quickly measure a reveal without covering a large area. Most desirably, the juncture between edges 132 and 136 occurs at the same three-sixteenths of an inch from layers 110 and 120. This way, when casing strip 250 is to be installed on wall 230 and jamb 210, as shown in FIG. 4, there will be no error introduced in the placement.

The process of installing casing is simple and almost intuitive, even from installation of the very first casing strip. First, tool 100 is pressed against window jamb 210, with, for this example, edge 122 pressed against jamb 210 and layer 130 with edge 132 overlapping jamb 210. Tool 100 will be pressed into the corner between jamb 210 and jamb 220 by manually applying force to tool 100 in a direction as shown by line 150, so that the two perpendicular jambs 210, 220 are both overlapped by layer 130. Next, casing piece 250 will be slid into tight alignment with tool 100 and wall 230. The shorter edge 252 of the two long edges of casing piece 250 may be abutted against edge 132, and angled edge 256 of casing piece 250 is then abutted against edge 136. This process of abutting casing piece 250 against both edge 132 and edge 136 ensures casing piece 250 is located accurately in all three dimensions, with wall 230, edge 136 and edge 132 each forming a stop against which casing piece 250 may be held. Next a nail gun or other tool will be used to apply a first fastener to casing 250. Once casing 250 is fixed relative to wall 230, tool 100 may be rotated so that extension 135 is no longer engaged with casing 250. Tool 100 may then be slid downwards, as indicated by arrow 152, and nails or other fasteners may be inserted through casing 250 to further anchor casing 250 to wall 230 and jamb 210. With the use of a nail gun, regardless of whether the gun actuation is electric, pneumatic, explosive, mechanical lost motion or other, and tool 100, a single installer can slide tool 100 and simultaneously affix casing 250, thereby ensuring proper placement throughout the entire installation.

While the foregoing details what is felt to be the preferred embodiment of the invention, as required by the statutes, no material limitations to the scope of the claimed invention is intended. While a limited number of alternative embodiments have been referenced herein, additional features and design alternatives will be obvious to one of ordinary skill in the art upon review of the present disclosure, and these alternatives are considered to be incorporated herein. For example, the invention is illustrated in the preferred embodiment as being constructed from three layers of material. The working surfaces of tool 100 only require two distinct parallel but offset edges, and so only two layers are required for a fully functional tool. Nevertheless, three layers are preferred, to allow tool 100 to be manipulated right or left handed, from any of a variety of directions, thereby ensuring the easiest use regardless of the handedness or other preference of each individual user.

Therefore, the scope of the invention not limited by the foregoing description, and is instead set forth and particularly described in the claims herein below.

I claim:

1. A window casing installation tool for accurately aligning casing to first and second generally planar faces of a portal jamb, comprising:

a first generally planar surface for abutting with said first planar face;

a second generally planar surface or abutting with said second planar face;

a third generally planar surface for abutting with said casing, said third surface spaced from said first surface by a predetermined reveal amount;

a fourth generally planar surface for abutting with said casing, said fourth surface extending at a one hundred and thirty-five degree angle from said third surface; and first and second relatively planar layers, said first surface formed from an edge of said first layer and said second surface formed from a major surface of said second layer, said third and said fourth surfaces formed from two edges of said second layer;

wherein said first layer is generally rectangular, and said first surface is recessed relative to said third surface;

whereby said tool may be engaged with said portal jamb and said casing engaged with said third and fourth surfaces, to precisely and repeatedly locate said casing relative to said jamb.

2. The window casing installation tool of claim 1 further comprising a hole extending through said tool whereby a user may manually grasp said tool through said hole.

3. The window casing installation tool of claim 1 wherein two edges of said first layer are recessed from parallel but offset edges of said second layer by the same reveal distance.

4. The window casing installation tool of claim 1 wherein three edges of said first layer are recessed from parallel but offset edges of said second layer by the same reveal distance.

5. The window casing installation tool of claim 1 wherein two edges of said first layer are recessed from parallel but offset edges of said second layer by different predetermined reveal distances.

6. The window casing installation tool of claim 1 wherein said tool comprises a transparent material through which light and images will pass.

7. The window casing installation tool of claim 6 further comprising distance graduations formed upon said tool.

8. A method for installing trim about a portal having a jamb with an interior face, an exterior face parallel to said interior face, and an opening face perpendicular to said interior face, comprising the steps of:

placing a guide having a first intersection formed between two planes, a second intersection angularly offset by a first angle from said first intersection, and an additional plane angularly offset by a second angle from said first intersection against said interior face and said opening face of said portal wherein said first intersection meets at a juncture between said interior face and said opening face;

moving said guide along said opening face while still adjacent thereto until said second intersection engages said portal against a first edge formed from an angular change in direction of said portal opening face;

abutting said trim against said additional plane with a length of said trim extending parallel to said first intersection and abutted against said guide along a first portion of said length; and fastening said trim relative to said portal.

9. The method for installing trim about a portal of claim 8 further comprising the step of manually grasping said guide through a central hole.

10. The method for installing trim about a portal of claim 8 further comprising the step of applying force to said guide subsequent to said step of moving to retain said guide in said engagement until after said fastening.

11. The method for installing trim about a portal of claim 8 further comprising the step of sliding said first intersection parallel to said juncture and away from said first edge.

12. The method for installing trim about a portal of claim 11 further comprising the step of applying a second fastener to said trim after said step of sliding.

13. The method for installing trim about a portal of claim 11 further comprising the step of rotating said guide prior to said step of sliding.

14. A hand-held tool for accurately locating window casing during installation, comprising:

first and second rectangular frames each having a perimeter about first, second, third and fourth edges, a major surface, and a central opening;

a third frame adjacent and between said first and second frame major surfaces, said third frame having a central opening, a first major surface adjacent said first frame, a second major surface adjacent said second frame, and a perimeter having first, second, third, fourth and fifth edges, said first edge of said third frame located parallel to said first edge of said first and second frames, but farther from said central opening, said second edge of said third frame located parallel to said second edge of said first and second frames, but farther from said central opening, said third edge of said third frame located parallel to said third edge of said first and second frames, but farther from said central opening, and further having a protrusion bordered by said fourth and fifth edges of said third frame extending from said rectangular body portion farther than said first frame, said fourth edge of said third frame extending generally at a one hundred and thirty-five degree angle from said third edge of said third frame;

said central opening coextensive and aligned through each of said first, second and third frames through which a hand may pass and grasp said tool, whereby said hand-held tool may be used to measure and locate a reveal using any of said first, second or third edges of said third frame in conjunction with an associated edge selected from said first, second, third or fourth edges of said first frame or said first, second, third, or fourth edges of said second frame, and whereby said third and said fourth edges of said third frame may be used to locate the end of a pre-cut casing strip adjacent a portal in all three dimensions.

15. The hand-held tool of claim 14 wherein said first, second and third frames are transparent, and said tool has visible scribe marks.

16. The hand-held tool of claim 14 further comprising a notch extending between said fourth and fifth edges which provides an exact offset for measuring or setting, a reveal.

* * * * *